US005474427A

United States Patent [19]

Redetzke

[11] Patent Number: 5,474,427

[45] Date of Patent: Dec. 12, 1995

[54] FAN SCREEN ASSEMBLY

[75] Inventor: Donovan A. Redetzke, Altoona, Wis.

[73] Assignee: J & D Sales of Eau Claire Wisconsin, Eau Claire, Wis.

[21] Appl. No.: 133,903

[22] Filed: Oct. 12, 1993

[51] Int. Cl.[6] ..... F04D 29/70

[52] U.S. Cl. ..... 416/247 R; 415/121.2

[58] Field of Search ..... 416/247 R; 415/121.2, 415/201; 417/234, 360

[56] References Cited

U.S. PATENT DOCUMENTS

| | | | |
|---|---|---|---|
| 1,971,827 | 8/1934 | Morse | 417/234 |
| 2,017,431 | 10/1935 | Anderson et al. . | |
| 2,259,853 | 10/1941 | Koch . | |
| 2,373,497 | 4/1945 | Paiste, Jr. | 415/201 |
| 2,617,583 | 11/1952 | Kemler . | |
| 2,624,504 | 1/1953 | Viewegh . | |
| 2,656,974 | 10/1953 | Holstein . | |
| 2,728,519 | 12/1955 | McLarty . | |
| 2,829,819 | 4/1958 | Corwin . | |
| 2,862,652 | 12/1958 | Holby et al. . | |
| 2,862,657 | 12/1958 | Copeland et al. . | |
| 3,262,638 | 7/1966 | Militello . | |
| 3,347,452 | 10/1967 | Radcliffe . | |
| 3,787,142 | 1/1974 | Dupke . | |
| 3,791,333 | 2/1974 | Losch . | |
| 3,963,382 | 6/1976 | Patton . | |
| 4,018,270 | 4/1977 | Kolinger et al. | 165/119 |
| 4,022,548 | 5/1977 | McLarty . | |
| 4,222,318 | 9/1980 | Patton et al. . | |
| 4,657,485 | 4/1987 | Hartwig . | |
| 4,818,183 | 4/1989 | Schaefer . | |
| 5,348,447 | 9/1994 | Redetzke | 416/247 R |

OTHER PUBLICATIONS

Dayton, Installation Instructions & Parts Manual, *36" Galvanized Vertical Direct–Drive Poultry Fan,* Jul. 1991, pp. 1–4.

Dayton, *Grainger®*, 1990 W. W. Grainger, Inc.

Raydot Inc., Total Ventilation Systems, *36 & 48 Series Fiberglass Flush Mount Belt Drive Exhaust Fans,* Jun. 1989.

Dynavent Farm Equipement Inc., *Hay Drying Fans.*

Dynavent Farm Equipment Inc., *Portable Barn Fan.*

Agro–Power Galvanized Wall Fans.

Dayton, Operating Instructions & Parts Manual, *Utility Shutter–Mounted Exhaust Fans,* pp. 1–4.

Dayton, Operating Instructions & Parts Manual, *Guard–Mounted Exhaust Fans,* pp. 1–4.

Dayton, Operating Instructions & Parts Manual, *Air Circulator,* pp. 1–6.

Dayton, Operating Instructions & Parts Manual, *20" Whole House Window Fan,* pp. 1–4.

Dayton, Operating Instructions & Parts Manual, *36" Direct–Drive Mobile Air Circulator,* pp. 1–4.

Dayton, Operating Instructions & Parts Manual, *Shutter–Mounted Exhaust Fans,* pp. 1–4.

Dayton, Operating Instructions & Parts Manual, *Slant–Wall Housing Kit,* pp. 1–4.

Dayton, Operating Instructions & Parts Manual, *36" & 48" Galvanized Vertical Belt–Drive Agricultural Fan.*

Dayton, Operating Instructions & Parts Manual, *48" Galvanized Vertical Belt–Drive Poultry Fan,* pp. 1–4.

Dayton, Operating Instructions & Parts Manual, *36" Galvanized Vertical Belt–Drive Poultry Fan,* pp. 1–4.

Dayton, *Assembled Vertical Direct–Drive Poultry Fan and 12 to 20 Adjustable Speed Exhaust Fans.*

*Primary Examiner*—Edward K. Look
*Assistant Examiner*—James A. Larson
*Attorney, Agent, or Firm*—Kinney & Lange

[57] ABSTRACT

A fan assembly having a housing having side walls, a fan having rotating blades mounted within the housing and a fan screen mounted relative to the housing and spaced from the rotating blades. The fan assembly includes a housing having two parallel spaced tracks for slidable reception of a pair of opposed parallel edges of the fan screen. The fan screen is slidably moveably between an operable position in front of the rotating blades and a fan clean-out position where the fan screen is at least partially disengaged from the tracks of the housing.

4 Claims, 2 Drawing Sheets

FAN SCREEN ASSEMBLY

BACKGROUND OF THE INVENTION

This invention relates to a fan assembly, particularly to a fan assembly of the type which has a housing having side walls, a fan having rotating blades mounted within the housing and a slidable fan screen mounted relative to the housing and spaced from the rotating blades.

In the fan industry, there is a need for a fan housing which allows ready access to the fan unit within the housing for cleaning and maintenance purposes. While being readily accessible for cleaning and maintenance purposes, the fan housing must allow a maximum amount of the air flow through the fan while still providing a safety guard which prevents objects from getting into the path of the fan blades.

A primary concern of the fan industry is safety. During typical fan operation, fan blades am rotated at high RPM's. These rotating fan blades are often enclosed within a fan housing which contains front and rear guards (typically made of wire) in order to limit access to the fan blades during fan operation. Circulating fans are often installed in industrial or agricultural applications, which are notoriously unclean environments. In these types of applications, fans are wall mounted to exhaust air or ceiling hung for providing ventilation to livestock. In these harsh environments, hay, straw, dust, chicken feathers, or other airborne material typically become lodged within the fan housing. Therefor, the fan housing must allow easy access to the fan unit for cleaning and maintenance.

In the past, fans for these applications have had fan housings which include rear and front shielded fan guard faces, with totally or partially shielded side walls. The shielded rear and front fan guard faces will permit some objects to pass partially therethrough. A totally or partially enclosed circumferential side wall connects the rear and front guard faces to enclose the fan blades. The fan blades may be located approximately equal distances from the front and back guard faces, with the guard faces being far enough away from the fan blades to prohibit a human hand from reaching the blade path.

The front and rear fan guards of these devices have been limited to guards that are secured to the fan housing side wall by methods which require the use of tools for removing the guards for access to the fan units for cleaning and maintenance purposes. The methods of securing the front or rear fan guard to the fan housing side wall typically consists of a bolted or screw connection, or even a permanent welded connection of the fan guard to the fan housing side wall.

Since the fan guards are fixedly secured to the fan housing, tools such as screwdrivers and wrenches: and excessive handling is required to open the fan for cleaning and maintenance purposes. As mentioned, these fans are often located in harsh environments, where hay, straw, dust, chicken feathers, or other airborne material typically become lodged within the fan housing. Regular maintenance and cleaning or these fans to remove such material is required to keep these fans operating at maximum efficiency. Since several fans are usually located within a single barn or shed, the removal of the fan guards for cleaning or maintenance purposes becomes labor intensive and time consuming.

SUMMARY OF THE INVENTION

The present invention is directed to a fan assembly of the type which has a housing having side walls, a fan having rotation blades mounted within the housing, and a fan screen. The fan screen is mounted relative to the housing and spaced from the rotating blades. The inventive fan assembly includes the housing having two parallel spaced tracks for slidable reception of a pair of parallel edges of the fan screen. The fan screen is slidably movable between an operable position in front of the rotating blades and a fan clean-out position disengaged or partially disengaged from the tracks of the housing. This allows easy removal of the fan screen for access to the fan unit for cleaning and maintenance purposes. In one preferred embodiment, the fan screen assembly may include at least one manually operable side clip mounted to the fan housing for securing the fan screen to the fan assembly.

BRIEF DESCRIPTION OF THE DRAWINGS

The invention is further described with reference to the accompanying drawings, where like numbers refer to like parts in several views.

These drawing figures are provided for illustrative purposes only and are not drawn to scale, nor should they be construed to limit the intended scope and purpose of the present invention.

DETAILED DESCRIPTION OF THE PREFERRED EMBODIMENTS

Figure 1:
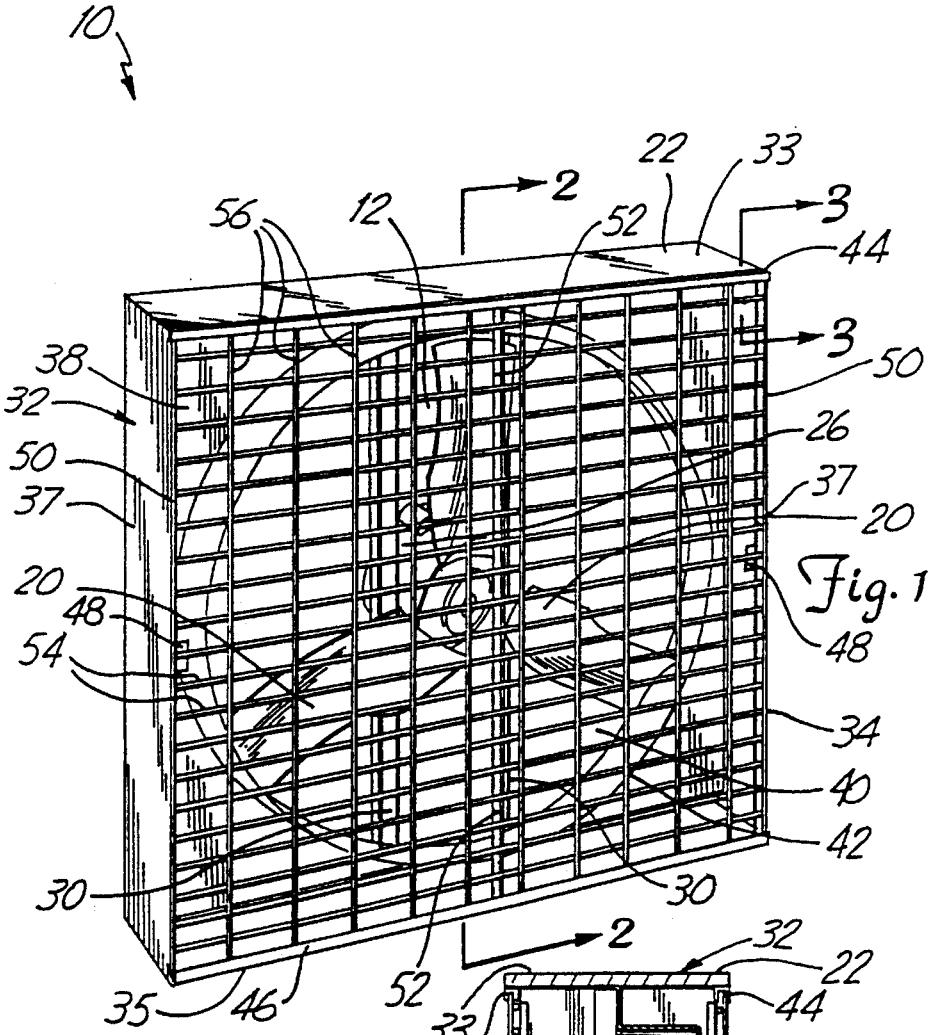
FIG. 1 is a perspective view of a fan showing the present fan screen assembly invention.
Figure 2:
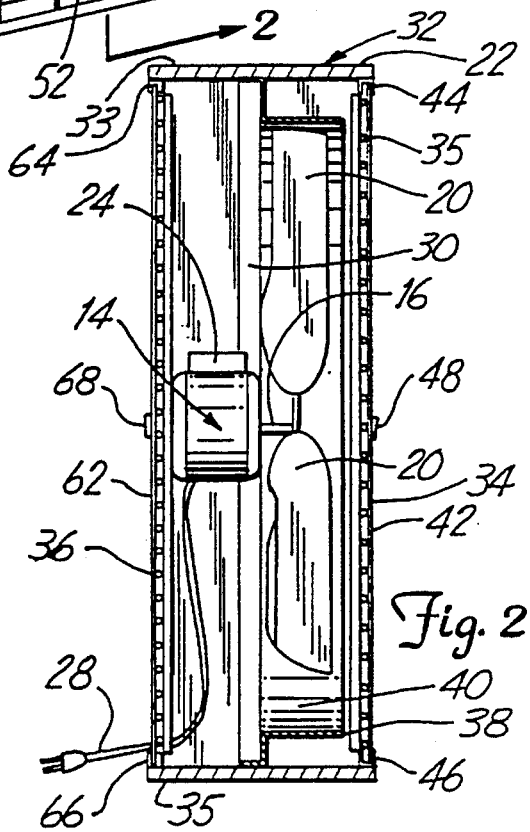
FIG. 2 is a sectional view as taken along line 2—2 of FIG. 1.

In FIG. 1, a fan assembly is shown generally at 10 with the fan screen assembly of this invention being shown generally at 12. As seen in FIG. 2, a fan motor 14, a motor shaft 16, and fan blades 20 are mounted within a fan housing 22. A starting capacitor 24, fan motor mounting plate 26, an electric power source connector 28 are attached to the fan motor 14 within the fan housing 22.

Two fan motor supports 30 extend from the bottom of the fan housing 22 to the top of the fan housing 22. The fan motor mounting plate 26 is bolted to the fan motor supports 30 for supporting the fan motor 14 within the fan housing 22. Typical mounting applications for the fan assembly 10 include wall mounting the fan assembly 10 for air exhaust or hanging the fan assembly 10 from a ceiling or rafter for ventilation.

The fan motor 14 is connected to the motor shaft 16 which in turn is connected to the fan blades 20. The fan assembly 10 is powered through the electric power source connector 28 which supplies power to the fan motor 14. In one embodiment, a starting capacitor 24 is used to start the fan motor 14. The fan motor 14 converts electrical energy to mechanical energy which rotates the motor shaft 16 and fan blades 20 which are attached to the motor shaft 16. This system results in typical fan operation, whereby the fan blades 20 are rotated at higher RPM's.

The rotating fan blades 20 are encased within the fan housing 22. The fan housing 22 of the invention generally includes an outer wall 32, a front fan screen assembly 34, and rear fan screen assembly 36. The outer wall 32 is located adjacent the fan blade 20 path and may take on any structural shape or form (e.g., round, rectangular, etc.). The outer wall 32 includes a top wall 33, bottom wall 35, and side walls 37. Typically, the outer wall 32 is formed in a rectangular or circular shape. The outer wall 32 may consist of sheet metal, plastic, wood, or any other solid material typically used for fan applications. The outer wall 32 also may consist of parallel circumferential or rectangular wires which when secured together form the outer wall 32. In one embodiment, the outer wall 32 consists of plywood, which is nailed or screwed together in a rectangular form. This embodiment includes an inner sleeve 38 which consists of a rectangular piece of sheet metal fitted inside the rectangular shaped outer wall 32, and which includes a circular opening 40 in which the diameter of the circular opening 40 is greater than the diameter of the fan blade 20 path. Secured to the outer wall 32 is a front fan screen assembly 34 and a rear fan screen assembly 36.

The front fan screen assembly 34 includes a fan screen 42, an upper track 44, a lower track 46 and a side clip 48. The fan screen 42 includes an outer support wire 50, vertical support wire 52, horizontal wires 54, and vertical wires 56. In one embodiment as shown in FIG. 1, the outer support wire 50 is the same general rectangular shape as the rectangular outer wall 32. A vertical support wire 52 runs from the center of the bottom of the outer support wire 50 (shown in FIG. 1 located along the bottom wall 35) to the center of the top of the outer support wire 50 (shown in FIG. 1 located along the top wall 33). It is securely attached to the outer support wire 50 with spot-welds. Horizontal wires 54 are spaced parallel horizontally from the bottom of the outer support wire 50 to the top of the outer support wire 50. Vertical wires 56 are spaced parallel from one side of the outer support wire 50 to the other side of the outer support wire 50. Together, the horizontal wires 54 and vertical wires 56 form a cross-hatched fan screen 42 and are securely attached with a spot weld to the outer support wire 50, vertical support wire 52, and to each other at each point where they cross, intersect, or meet each other.

Figure 3:
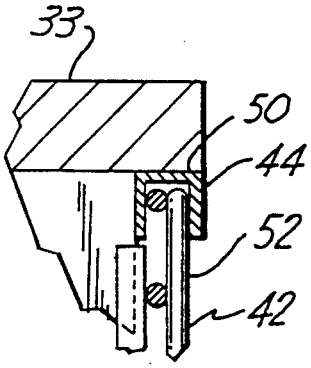
FIG. 3 is an enlarged sectional view as taken along line 3—3 of FIG. 1.
Figure 4:
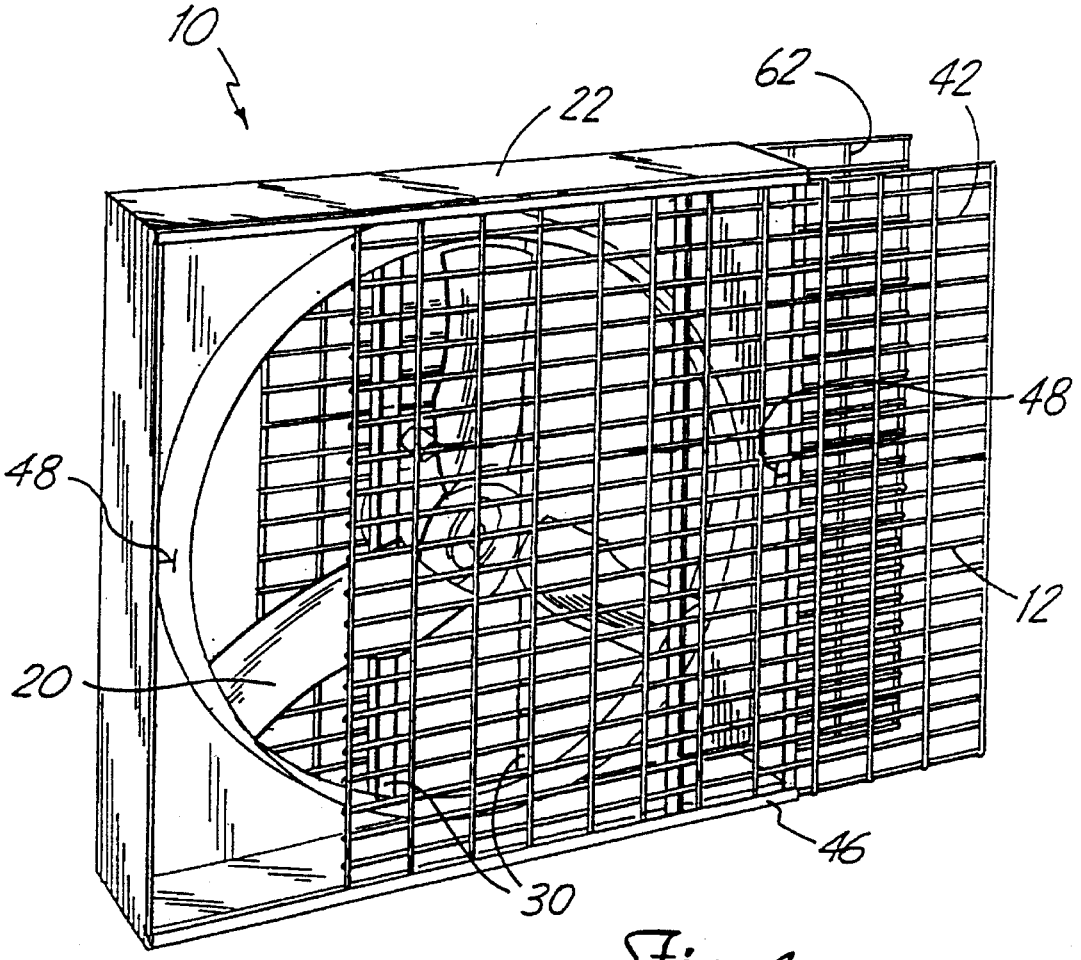
FIG. 4 is a perspective view of a fan showing the present fan screen assembly invention in a clean-out position.

The fan screen 42 is slidably receivable between the upper track 44 and lower track 46, both of which are U-shaped. The upper track 44 is mounted to the underside of the fan top wall 33 where it extends beyond the front of the side wall 37. The lower track 46 is mounted to a top side of the bottom wall 35 where the fan housing bottom wall 35 extends beyond the front of the side wall 37 (and in alignment with the upper track 44). FIG. 3 shows how the fan screen 42 fits within the upper track 44. The front fan screen assembly 34 allows the fan screen 42 to slide between an operable position shown in FIG. 1 and a clean-out position shown in FIG. 4. The clean-out position allows access to the interior of the fan assembly 10 for maintenance and cleaning purposes. In its clean-out position, the fan screen 42 may be completely disengaged and removed from the fan 10. The fan screen 42 may also be slid to either side to allow access to fan screen assembly 34, while still engaged between the upper track 44 and lower track 46.

When the fan screen 42 is in the operable position, the fan screen 42 is secured to the outer wall 32 using one or more side clips 48. Each side clip 48 is mounted on one of the side walls 37 of the outer wall 32, and is manually manipulated to engage and disengage the fan screen 42 from sliding movement with respect to the fan housing 22 so that the movement of the fan screen 42 between its operable position and its clean-out position is accomplished without the use of tools. The side clip may take the form of any suitable and simple latching mechanism to secure the fan screen 42 from sliding movement relative to the fan housing 22 (such as, for example, a pivotally mounted finger secured on the side wall 37 (as shown) or a retractable sliding mechanism) which, in its locking position, protrudes though one of the openings in the fan screen 42 adjacent the side wall 37.

The rear fan screen assembly 36 is located as shown in FIG. 2, and includes a fan screen 62, an upper track 64, a lower track 66, and a side clip 68. Like the front fan screen assembly, the rear fan screen assembly allows the fan screen 62 to slide within the upper track and lower track between an operable position and a clean-out position. One or more side clips are used to manually secure the fan screen 62 to the outer wall 32.

In a fan assembly which has front and rear axially spaced safety screens, one on each side of the fan blades, only the front (or only the rear) safety screen may be slidably movable.

Although the present invention has been described with reference to preferred embodiments, workers skilled in the art will recognize that changes may be made in form and detail without departing from the spirit and scope of the invention. For example, the fan housing may be any given shape to fit different applications, such as a circular shape, as long as it has two parallel edges. In a circular application, the fan may be wall mounted with the fan screen assembly (including an upper and lower track) mounted to the wall. In an alternative embodiment, the diameter of the front of the fan assembly 10 may be greater than the diameter of the rear of the fan assembly 10. Also, the diameter of the fan blade 20 path may vary, for example, typical fan assembly 10 sizes include 12 inches, 20 inches, 24 inches, and 36 inches. The type of fan screen may also vary, including being totally open or louvered.

What is claimed is:

1. In a fan assembly of the type which has a housing having side walls, a fan having rotating blades mounted within the housing and a fan screen mounted relative to the housing and spaced axially from the rotating blades, the improvement which comprises:

the housing having two parallel spaced tracks for slidable reception of a pair of opposed parallel edges of the fan screen whereby the fan screen is slidably movable between an operable position in front of the rotating blades and a fan clean-out position where the fan screen is at least partially disengaged from the tracks of the housing; and means for securely attaching the fan screen to the fan housing side walls.

2. The fan assembly of claim 1 wherein the attaching means includes at least one manually operable clip mounted to the fan housing for attaching the fan screen to the housing.

3. In a fan assembly of the type which has a housing having side walls, a fan having rotating blades mounted within the housing and a fan screen mounted relative to the housing and spaced axially from the rotating blades, the improvement which comprises:

the housing having two parallel spaced tracks for slidable reception of a pair of opposed parallel edges of the fan screen whereby the fan screen is slidably movable between an operable position in front of the rotating blades and a fan clean-out position where the fan screen is at least partially disengaged from the tracks of the housing, wherein the housing includes a front side and a rear side, the fan assembly includes a rear fan screen adjacent the rear side, and the fan screen is located adjacent the housing front side.

4. In a fan assembly of the type which has a housing having side walls, a fan having rotating blades mounted within the housing and a fan screen mounted relative to the housing and spaced axially from the rotating blades, the improvement which comprises:

the housing having two parallel spaced tracks for slidable reception of a pair of opposed parallel edges of the fan screen whereby the fan screen is slidably movable between an operable position in front of the rotating blades and a fan clean-out position where the fan screen is at least partially disengaged from the tracks of the housing, wherein the housing includes a front side and a rear side, the fan assembly includes a rear fan screen similar to the fan screen, and the fan screen is located adjacent the fan housing front side and the rear fan screen is located adjacent the fan housing rear side.

* * * * *